US006149477A

United States Patent [19]

Toyama

[11] Patent Number: 6,149,477

[45] Date of Patent: Nov. 21, 2000

[54] AIR INTAKE DEVICE FOR AN OUTBOARD MOTOR

[75] Inventor: Takashi Toyama, Hamamatsu, Japan

[73] Assignee: Suzuki Motor Corporation, Shizuoka, Japan

[21] Appl. No.: 09/433,355

[22] Filed: Nov. 4, 1999

[30] Foreign Application Priority Data

Nov. 12, 1998 [JP] Japan ..... 10-322304

[51] Int. Cl.[7] ..... B63H 21/10

[52] U.S. Cl. ..... 440/88; 123/516

[58] Field of Search ..... 440/88, 89, 900; 123/572, 516, 195 P, 195 C

[56] References Cited

U.S. PATENT DOCUMENTS 5,501,202 3/1996 Watanabe ..... 123/572

FOREIGN PATENT DOCUMENTS 9-280129 10/1997 Japan .

10-184352 7/1998 Japan .

*Primary Examiner*—Ed Swinehart

*Attorney, Agent, or Firm*—Finnegan, Henderson, Farabow, Garrett & Dunner, L.L.P.

[57] ABSTRACT

An intake device for an outboard motor having a vapor separator is provided. The intake device is simple to manufacture and prevents a flow of an unacceptably large volume of fuel vapor into an engine system. The intake device leads external air into the engine and the vapor separator separates fuel vapor from liquid fuel. The fuel vapor generated in the vapor separator is led into the intake device. The intake device has a partition to divide the intake device into an intake passage and a vapor chamber. The partition is arranged downstream of the fuel vapor in the vapor chamber.

5 Claims, 6 Drawing Sheets

AIR INTAKE DEVICE FOR AN OUTBOARD MOTOR

CROSS REFERENCE TO RELATED APPLICATION

The present application claims priority from Japanese Patent Application No. Hei 10-322304, the content of which is incorporated herein by reference.

BACKGROUND OF THE INVENTION

The present invention relates to an air intake device for an outboard motor.

Fuel supply devices for an engine that has a fuel injection system are sometimes provided with a vapor separator. The vapor separator separates fuel vapor from fuel, such as gasoline, and then releases the fuel vapor into the atmosphere to keep a constant pressure within the separator, while forwarding vaporless liquid fuel to a fuel pump. Releasing fuel vapor into the atmosphere, however, causes air pollution. Thus, recently this fuel vapor is forwarded into an engine intake system by a hose or the like, and the fuel vapor is combusted within the engine.

When an engine has once warmed up, a high temperature in the engine enclosure increases the fuel temperature, and results in a large volume of fuel vapor. When one tries to restart the engine, this large volume of fuel vapor flows into the engine intake system causing a rich air-fuel mixture, and restarting the engine becomes difficult.

Conventionally, this problem is handled by providing a canister. However, not only are canisters expensive, but also they are difficult to be placed within an engine enclosure of an outboard motor because of its limit space.

SUMMARY OF THE INVENTION

The objects of the invention are to provide an air intake device for an outboard motor, that is simple to manufacture and prevents a large volume of fuel vapor from flowing into an engine intake system.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

To attain the advantages and in accordance with the purposes of the invention, as embodied and broadly described herein, an air intake device includes a housing having a first port and a second port, the housing having an intake passage extending from the first port for flowing a fluid from the first port to the second port, and a vapor chamber having an opening for introducing a vapor from a vapor separator into the vapor chamber, and a partition formed downstream of the vapor flowing from the opening in the vapor chamber, the partition separating the vapor chamber from the intake passage.

To further resolve the problems discussed above, the air intake device includes a partition having an arched shape so that the intake passage widens as the intake passage extends from the first port.

In another aspect of the invention, the objects and advantages of the invention are attained by the air intake device having a gap between the partition and the housing, and the intake passage and the vapor chamber being connected through the gap.

In yet another aspect, the air intake device includes a partition integrally formed with the housing.

In another aspect, the air intake device includes a housing having a upper cover portion and a lower cover portion defining the intake passage and the vapor chamber.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENTS

Reference will now be made in detail to the present preferred embodiment of the invention, an example of which is illustrated in the accompanying drawings. Wherever possible, the same reference numbers will be used throughout the drawings to refer to the same or like parts.

In accordance with the invention, an air intake device for an outboard motor having a vapor separator, includes a housing having a first port and a second port, the housing having an intake passage extending from the first port for flowing a fluid from the first port to the second port, and a vapor chamber having an opening for introducing a vapor from the vapor separator into the vapor chamber. The air intake device also includes a partition formed downstream of the vapor flowing from the opening in the vapor chamber, the partition separating the vapor chamber from the intake passage.

Figure 1:
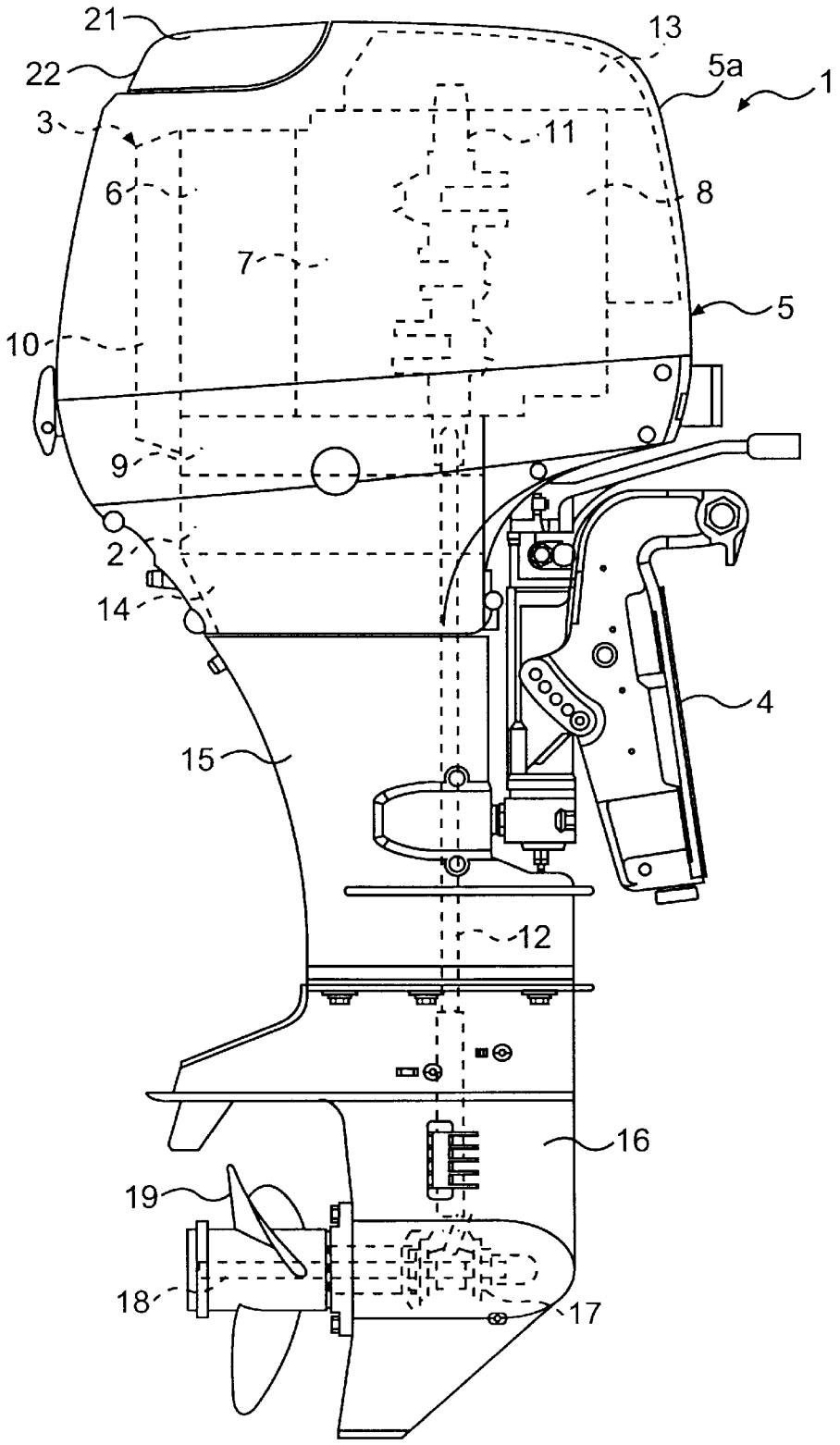
FIG. 1 is a right-side view of an outboard motor illustrating one embodiment of the air intake device according to the present invention.

FIG. 1 illustrates an outboard motor. As illustrated in FIG. 1, an outboard motor 1 has an engine holder 2 and an engine 3 above the engine holder 2. Also, a bracket 4 is installed on the engine holder 2 and, by this bracket 4, the outboard motor 1 can be mounted onto a transom (not shown in the figure) on a hull of a boat. Furthermore, the engine 3 is enclosed by an engine cover 5.

Figure 2:
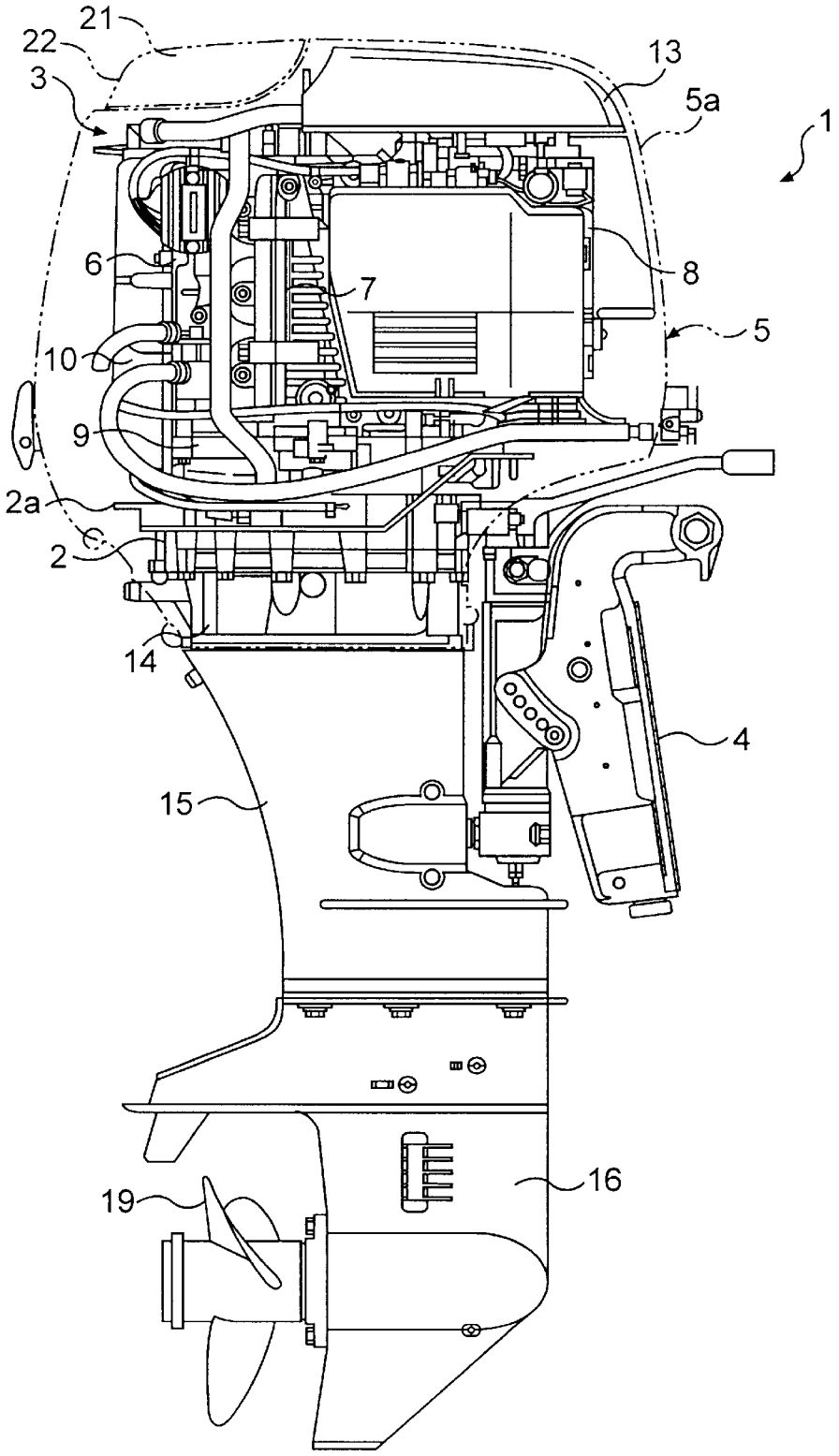
FIG. 2 is a right-side view of the outboard motor of FIG. 1, without an engine cover.

FIG. 2 shows the outboard motor 1 without the engine cover 5. As illustrated in FIGS. 1 and 2, the engine 3 in this outboard motor 1 may be, for example, a watercooled, four-cycle, three-cylinder engine. The engine 3 includes a cylinder head 6, a cylinder block 7, a crank case 8, and other structural components of an engine. The engine 3 is located over the engine holder 2 via a cam-chain case 9.

The cylinder block 7 is usually located at the foremost part, behind (left side) the crank case 8 located on the right side of the engine 3 in FIG. 2. Also, the cylinder head 6 is located behind the cylinder block 7. The back of the cylinder head 6 is covered with a head cover 10, and a breather chamber (not shown in the figure) is formed therein.

A crank shaft 11 is located perpendicularly within a part in which the crank case 8 and the cylinder block 7 join. See FIG. 1. In addition, the top end of a drive shaft 12 is, for example, spline-fitted to the bottom end of the crank shaft 11. Also, a magneto device (not shown in the figure) is provided on the top end of the crank shaft 11 and this magneto device is covered with a magneto cover 13.

An oil pan 14 is located below the engine holder 2, and a shaft housing 15 is located under the oil pan 14. Within the shaft housing 15, the drive shaft 12 extends downwardly, and a propeller is driven via a propeller shaft 18 and a bevel gear 17 inside a gear case located below the shaft housing 15.

Figure 3:
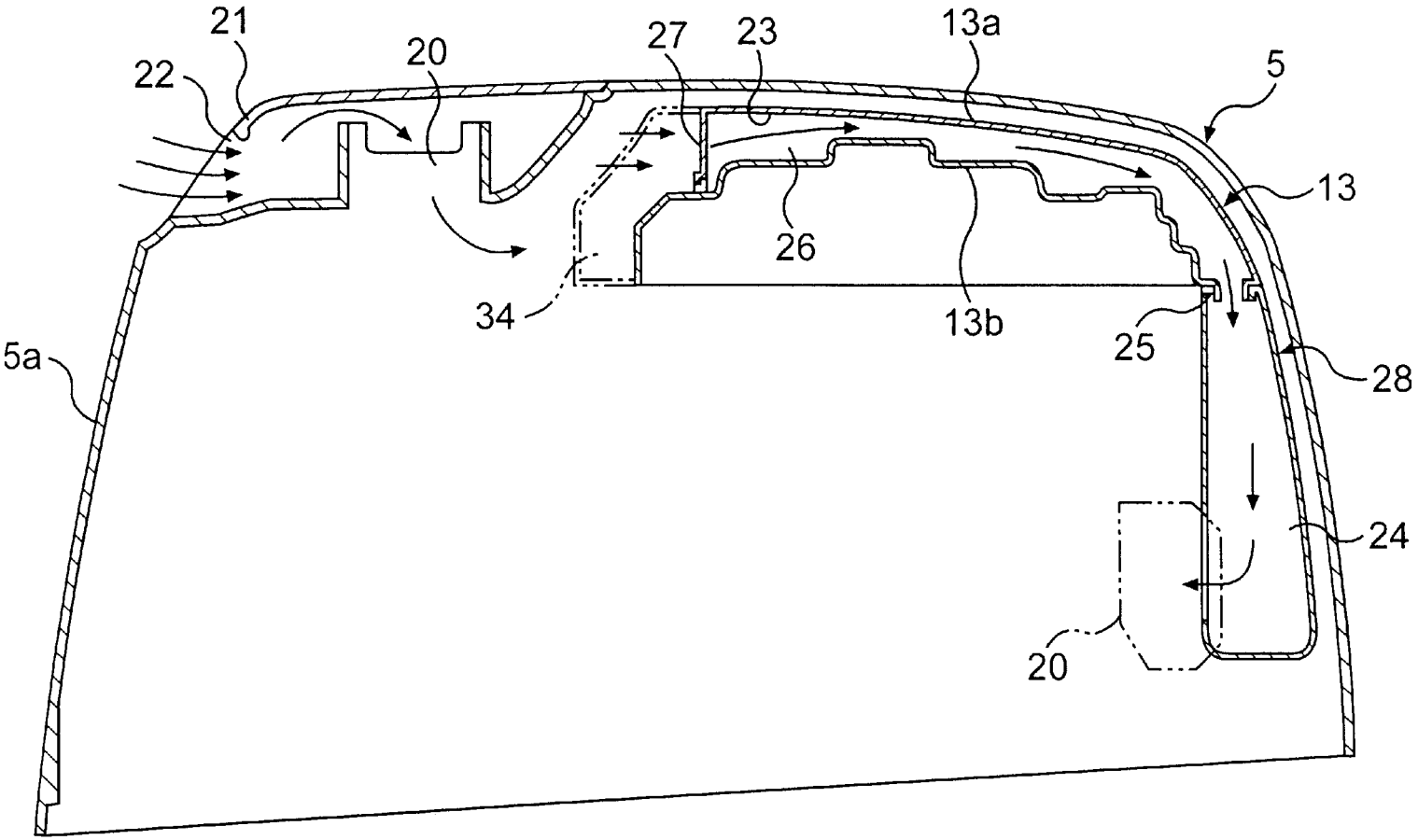
FIG. 3 is a vertical cross-sectional view of a part of an engine cover and a magneto cover.

FIG. 3 is a vertical cross-sectional view of a top cover 5*a* and the magneto cover 13. As illustrated in FIG. 3, an external air intake port 20 is formed in the upper rear side (the upper left side in FIG. 3) of the top cover 5*a*. This external air intake port 20 opens, for example, in an upward direction, and leads external air into the engine cover 5. A tilt-up handle 21 is located above the port 20, and an external air inlet 22 is formed in the rear part of the tilt-up handle 21.

The magneto cover 13 may include an upper cover 13*a* and a lower cover 13*b*. A first silencer 23 is formed within the magneto cover 13. The top part of a second silencer 24 is linked to the lower front part of the magneto cover 13. The first silencer 23 and the second silencer 24 communicate via a second port, which is a communication hole 25, and form an intake passage 26 of L-shaped configuration as viewed from the side. A first port, which is an intake port 27, is formed in the rear part of the upper cover 13*a*, and the intake port 27 opens toward the intake port 20 and connects to the air intake passage 26.

Figure 4:
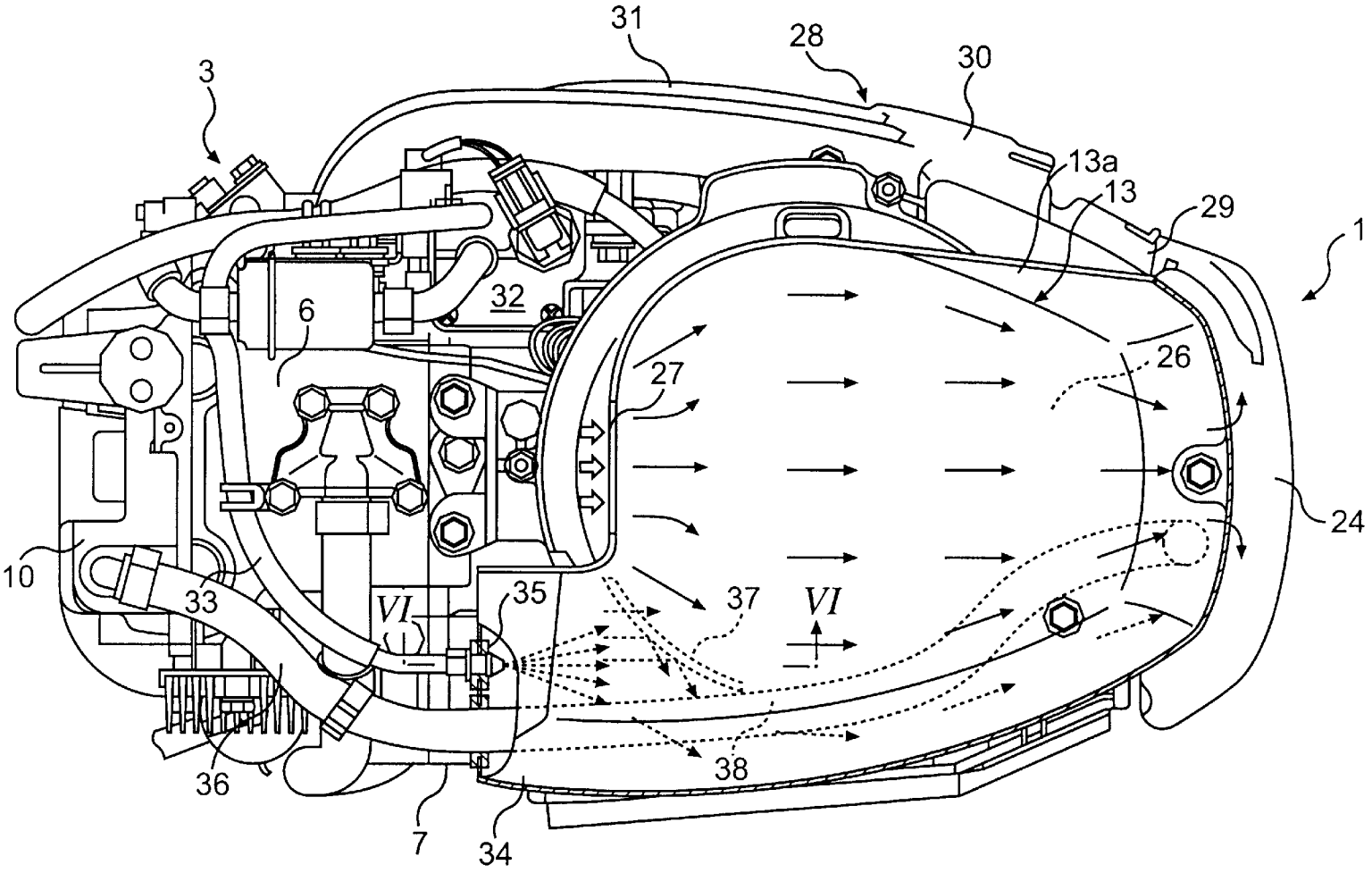
FIG. 4 is a top view of the outboard motor in FIG. 2.

FIG. 4 is a top view of the engine 3 without the engine cover 5. The engine 3 has the air intake device 28 according to the invention. The air intake device 28 mainly includes the first silencer 23, the second silencer 24, a throttle body 29, a surge tank 30, and an air intake manifold 31.

The throttle body 29 is located, for example, diagonally in front of the crank case 8, and a surge tank 30 is located in the downstream (the left side in FIG. 4) of this throttle body 20. The air intake manifold 31 extends from the surge tank 30 to each of the various cylinders, and is connected to an air intake port (not illustrated in FIG. 4) formed in the cylinder head. Also, the downstream side of the second silencer 24 is connected to the upstream side of the throttle body 29.

A vapor separator 32 is provided in the fuel system (not illustrated in the figure) of the engine 3. The vapor separator 32 separates fuel vapor contained in fuel such as gasoline, and leads the fuel vapor outside the vapor separator 32. The vapor separator 32 is located, for example, in a space between the air intake manifold 31 and the cylinder block 7. In the present invention, fuel vapor generated in the vapor separator 32 is led into the first silencer 23 by an evaporation hose 33.

Figure 5:
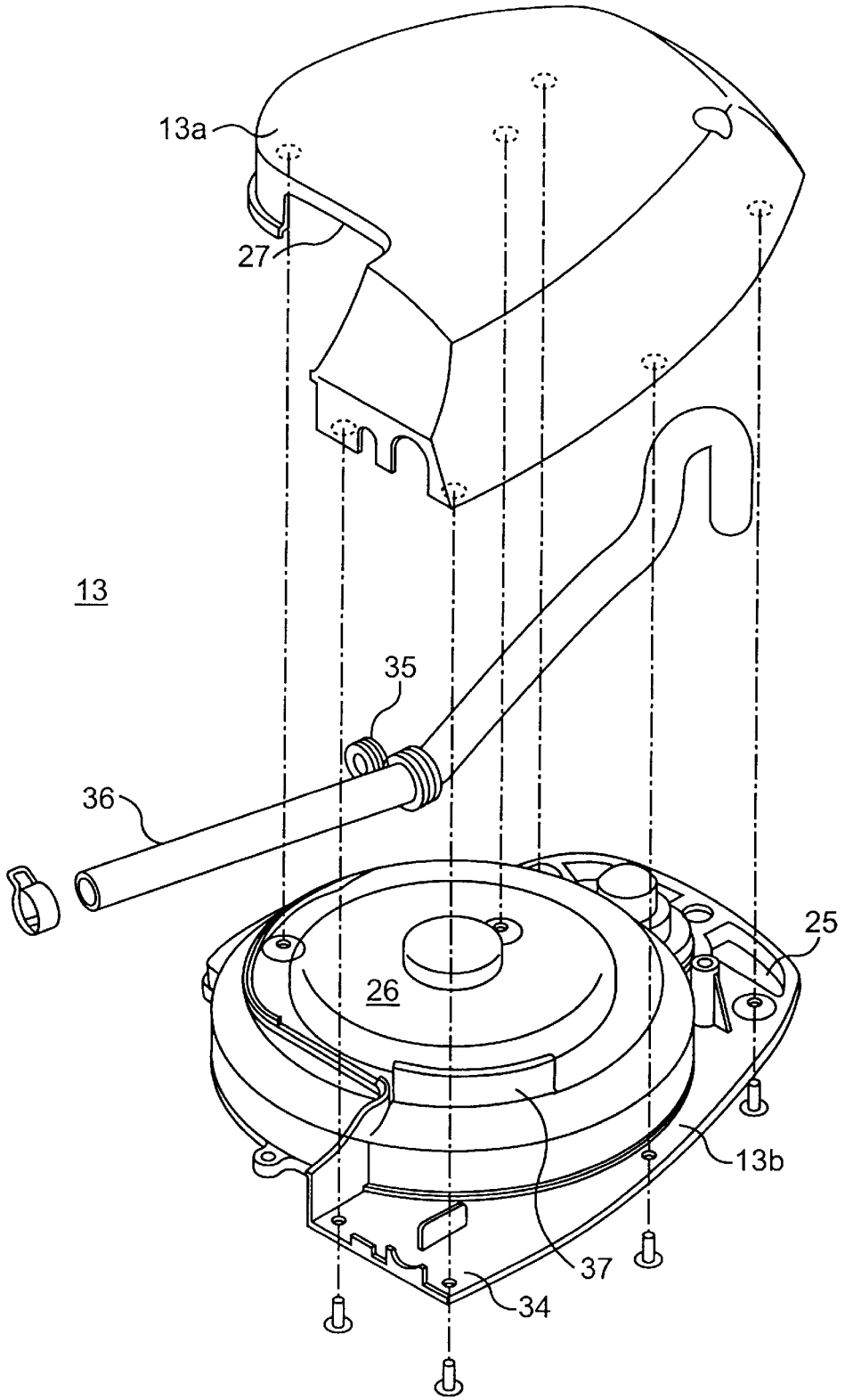
FIG. 5 a perspective view of the magneto cover of FIG. 3.
Figure 6:
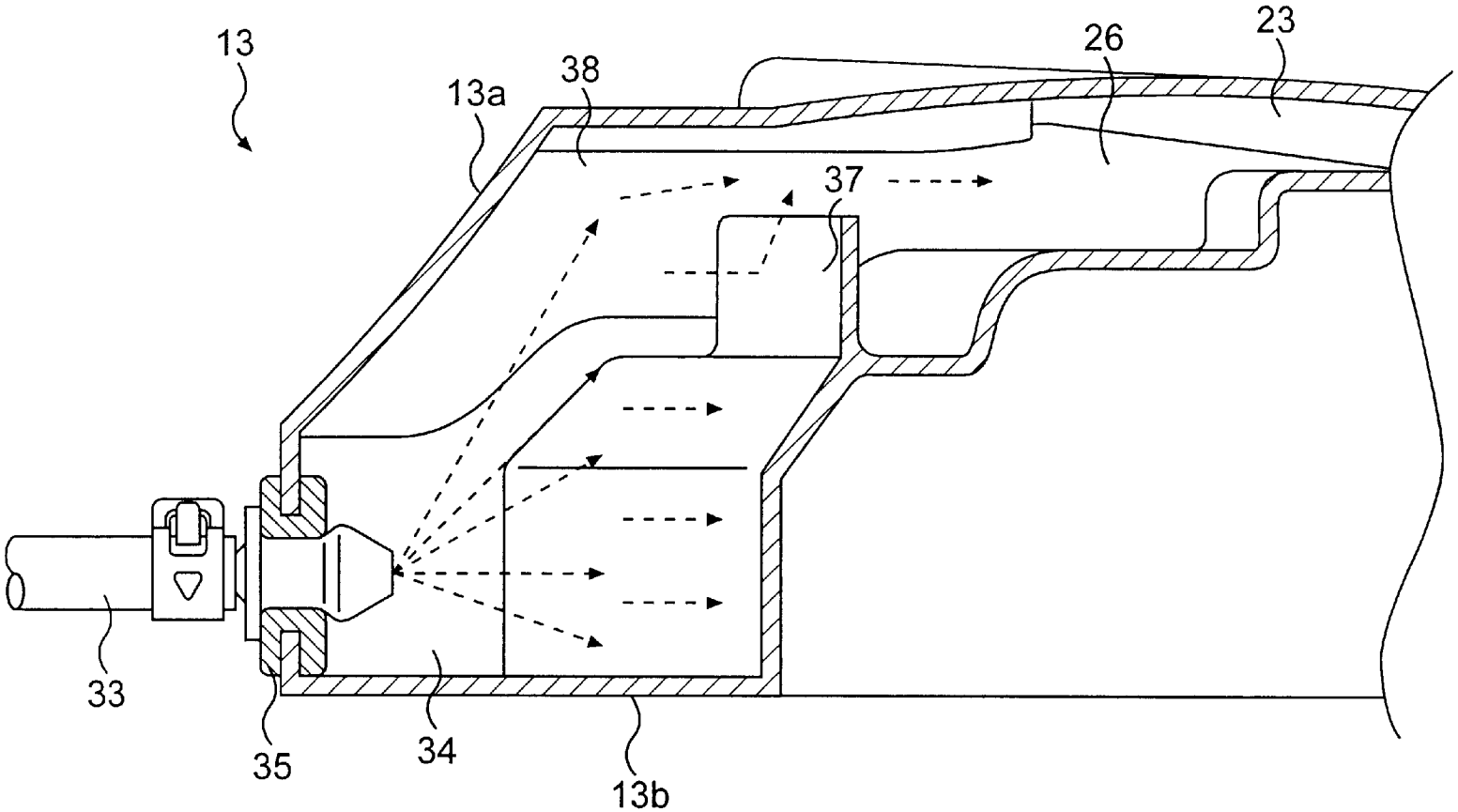
FIG. 6 is a cross-sectional view along line VI—VI of FIG. 4.

FIG. 5 is a perspective view of the magneto cover 13 having the first silencer 23 as the air intake device 28. FIG. 6 is a cross-sectional view cut along line VI—VI in FIG. 4. As illustrated in FIGS. 4–6, the air intake port 27 is formed approximately at the center of the rear surface of the upper cover 13*a*. A vapor chamber 34 is provided in a space that is offset from the air intake port 27 of the first silencer 23, and extends rearwardly (to the left side in FIG. 4).

The downstream end of an evaporation hose 33 that extends from the vapor separator 32 is connected to the vapor chamber 34 by, for example, a grommet 35, and the fuel vapor generated in the vapor separator 32 is led into the vapor chamber 34. Also, a breather hose 36 connects the breather chamber and the second silencer 24 in the head cover 10, and the breather hose 36 passes through the vapor chamber 34.

A partition 37 is located downstream of the fuel vapor in the vapor chamber 34, and the partition 37 separates the intake passage 26 and the vapor chamber 34. The partition 37 may be integrally formed with, for example, the lower cover 13*b*. This partition 37 is preferably formed with an arched shape, and is arranged such that the intake passage 26 widens as it extends from the intake port 27 to the downstream (to the side of the second silencer 24 in FIG. 4). In addition, a gap 38 is formed between the partition 37 and, preferably, the inner surface of the upper cover 13*a*, so that the fuel vapor in the vapor chamber 34 can flow through the gap 38 into the intake passage 26.

The operation of the described embodiment of this invention is explained below.

As illustrated in FIGS. 3 and 4, air advances from the external air intake port 20 into the engine cover 5, and the air is then led from the intake port 27 formed in the upper cover 13*a* to the intake passage 26 within the first silencer 23, as indicated by the solid-line arrows in the figures. The air is subsequently guided to the throttle body 29 via the second silencer 24.

As shown in FIGS. 4 and 6, the fuel vapor generated inside the vapor separator 32 is led into the vapor chamber 34 formed in the first silencer 23 by the evaporation hose 33, as shown by the broken-line arrow in the figures. Inside the intake passage 26, the fuel vapor from the vapor chamber 34 mixes with the air, and the mixture of the air and the fuel vapor is then led to the throttle body 29 via the second silencer 24.

When the engine 3 is restarted after being warmed up, the temperature in the engine cover 5 becomes high, and the gasoline temperature increases. As a result, a large volume of fuel vapor is generated within the vapor separator 32. When this large volume of fuel vapor is combined with air in the intake passage 26, the air-to-fuel ratio become fuel rich and it becomes difficult to restart the engine 3.

The partition 37 is provided in the first silencer 23 to section off the intake passage 26 and the vapor chamber 34. When the engine 3 is restarted, the fuel vapor is settled in the vapor chamber 34 without blending with the air inside the intake passage 26. Hence, an optimum air-to-fuel ratio can be maintained and the engine 3 can be readily restarted.

Preferably, the partition 37 has an arched shape when view from the top. The partition 37 is preferably arranged such that the intake passage 26 widens to the downstream side in the intake port 27, thus minimizing air intake resistance caused by the partition 37.

Furthermore, a gap 38 is formed between the partition 37 and the inner surface of the upper cover 13*a*. Thus, the fuel vapor in the vapor chamber 34 flows through the gap 38 into the intake passage 26 after the engine 3 is started. The fuel vapor then blends with the air to be supplied to the engine 3.

Preferably, the partition 37 is integrally formed with, for example, the lower cover 13*b*. Thus, the intake device of this invention is easy to manufacture, and the aforementioned objectives can be attained without largely increasing the number of parts.

As described above, the intake device for an outboard motor of the present invention includes a partition that divides the interior of the intake device into an intake passage and a vapor chamber. Fuel vapor from a vapor separator is led into the fuel chamber, and the partition is arranged in the downstream of the fuel vapor in the fuel chamber. When restarting an engine, the fuel vapor settles in the vapor chamber, and an optimum air-to-fuel ratio can be maintained. As a result, the engine can be restarted easily.

It will be apparent to those skilled in the art that various modifications and variations can be made in the air intake device of the present invention and in construction of this device without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. An intake device for an outboard motor having a vapor separator, the intake device comprising:

a housing having a first port and a second port, the housing having an intake passage extending from the first port for flowing a fluid from the first port to the second port, and a vapor chamber having an opening for introducing a vapor from the vapor separator into the vapor chamber; and a partition formed downstream of the vapor flowing from the opening in the vapor chamber, the partition separating the vapor chamber from the intake passage.

2. The intake device of claim 1, wherein the partition has an arched shape so that the intake passage widens as the intake passage extends from the first port.

3. The intake device of claim 1, wherein the device having a gap between the partition and the housing, the intake passage and the vapor chamber are connected through the gap.

4. The intake device of claim 1, wherein the partition is integrally formed with the housing.

5. The intake device of claim 1, wherein the housing has a upper cover portion and a lower cover portion defining the intake passage and the vapor chamber.

* * * * *